US009097399B2

(12) United States Patent
Fitzwater, II et al.

(10) Patent No.: US 9,097,399 B2
(45) Date of Patent: Aug. 4, 2015

(54) CORDLESS DECORATIVE LAMP

(76) Inventors: Stephen Travis Fitzwater, II, Fort Worth, TX (US); Carrie Marie Fitzwater, Fort Worth, TX (US)

( * ) Notice: Subject to any disclaimer, the term of this patent is extended or adjusted under 35 U.S.C. 154(b) by 110 days.

(21) Appl. No.: 13/357,495

(22) Filed: Jan. 24, 2012

(65) Prior Publication Data

US 2012/0188754 A1 Jul. 26, 2012

Related U.S. Application Data

(60) Provisional application No. 61/435,670, filed on Jan. 24, 2011.

(51) Int. Cl.

| | |
|---|---|
| ***F21S 8/08*** | (2006.01) |
| ***F21S 6/00*** | (2006.01) |
| ***F21S 9/02*** | (2006.01) |

(52) U.S. Cl.

CPC .. *F21S 6/002* (2013.01); *F21S 9/02* (2013.01); *Y10T 29/49117* (2013.01)

(58) Field of Classification Search

CPC ..... F21L 27/00; F21L 11/00; F21S 6/002; F21S 6/004; F21S 9/00; F21S 9/02; F21S 6/005

USPC ..... 362/183, 190, 410–415, 217.01–225, 362/395

See application file for complete search history.

(56) References Cited

U.S. PATENT DOCUMENTS

| | | | | |
|---|---|---|---|---|
| 5,065,292 | A | 11/1991 | Aubrey | |
| 322,684 | A | 12/1991 | Ping | |
| 5,734,229 | A | 3/1998 | Bavaro | |
| 6,102,549 | A * | 8/2000 | Thomas et al. | 362/183 |
| D450,881 | S * | 11/2001 | Burke | D26/112 |
| 6,599,000 | B2 | 7/2003 | Nolan | |
| 7,161,313 | B2 | 1/2007 | Piepgras | |
| 7,249,864 | B2 | 7/2007 | Smith | |
| 7,252,415 | B2 * | 8/2007 | Wang | 362/365 |
| 7,824,061 | B1 | 11/2010 | Riedfort | |
| 2003/0137831 | A1 * | 7/2003 | Lin | 362/183 |
| 2005/0174769 | A1 | 8/2005 | Yong | |
| 2005/0258954 | A1 | 11/2005 | Ruskin | |
| 2008/0091250 | A1 | 4/2008 | Powell | |
| 2008/0205050 | A1 * | 8/2008 | Moyer | 362/183 |
| 2010/0039792 | A1 * | 2/2010 | Meyers et al. | 362/20 |
| 2011/0075404 | A1 * | 3/2011 | Allen et al. | 362/183 |
| 2012/0113645 | A1 * | 5/2012 | Liao et al. | 362/253 |

FOREIGN PATENT DOCUMENTS

| | | | | |
|---|---|---|---|---|
| CN | 200986134 Y | * | 12/2007 | 362/183 |

OTHER PUBLICATIONS

Kim Blakesley, "How to Make Cordless Lamps", Aug. 3, 2010, eHow.com, Home Design and Decor, pp. 1-3; http://www.ehow.com/how_6812605_make-cordless-lamps.html.*

(Continued)

*Primary Examiner* — Jason Moon Han

(74) *Attorney, Agent, or Firm* — James E. Walton; Damon R. Hickman

(57) ABSTRACT

A decorative cordless lamp has a replaceable rechargeable energy storage device for powering an LED lighting element. The LED lighting element may be controlled by a variety of switches, timers, and sensors to enable the user to selectively tailor the operation of the decorative cordless lamp.

6 Claims, 11 Drawing Sheets

(56) References Cited

OTHER PUBLICATIONS

"Rechargeable Li-ion Battery Pack", Jun. 3, 2010, elementalled.com, pp. 1-2; http://www.elementalled.com/rechargeable-li-ion-battery-pack.html.*

Hanttula, "Converting teh IKEA Stollet Hanging LAmp into a better Table Lamp", Apr. 3, 2008, Instructables.com, http://www.instructables.com/id/Converting-the-IKEA-Stollet-Hanging-Lamp-Into-a-Be/?ALLSTEPS, pp. 1-5.*

Rechargeable led desk lamp, http://www.alibaba.com/product-gs/254734716/rechargeable_led_desk_lamp.html.

Led desk lamp, http://www.alibaba.com/product-gs/483827158/LED_Desk_Lamp.html.

Andrew Cooper, "A Darker View: A Red LED Desk Lamp", accessed Jan. 24, 2012 at http://www.darkerview.com/atm/redlamp.php.

Carl O'Donnell, "How to Convert a Lamp to Battery Power", accessed Jan. 24, 2012 at http://www.ehow.com/how_7789908_convert-lamp-battery-power.html.

* cited by examiner

CORDLESS DECORATIVE LAMP

This application claims the benefit of U.S. Provisional Patent Application No. 61/435,670 filed 24 Jan. 2011, titled "RECHARGEABLE BATTERY OPERATED DECORATIVE LAMP," which is hereby incorporated by reference for all purposes as if fully set forth herein.

BACKGROUND

1. Field of the Invention

The present invention relates in general to the field of remotely powered lamps.

2. Description of Related Art

There are many designs of decorative lamps well known in the art. Decorative lamps are typically tied to locations within a short distance of a wall outlet in order to power the light bulbs. Users of decorative lamps have been forced to plan lighting usage around the locations of electrical outlets or utilize unsightly electrical extension cords. While there are many decorative lamps well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
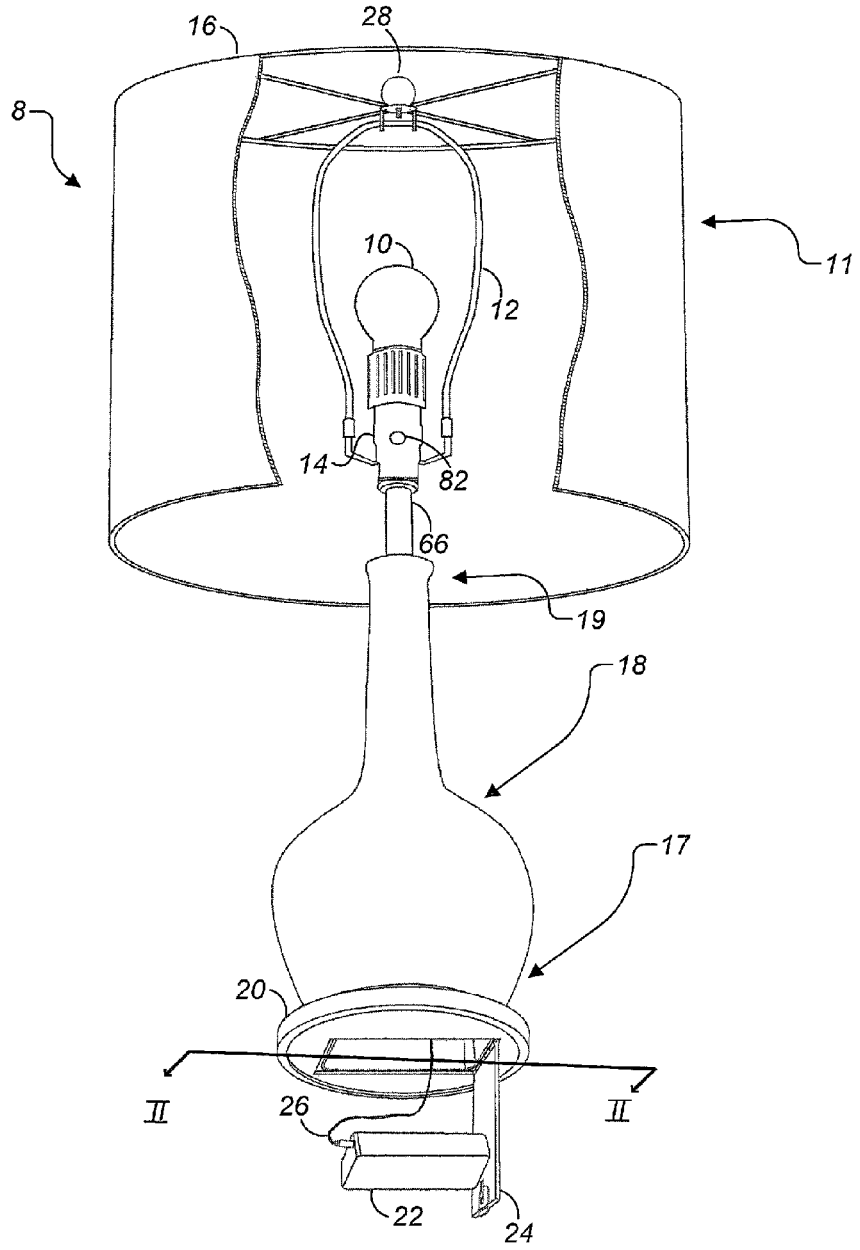
FIG. 1 is perspective view of the preferred embodiment of a cordless decorative lamp according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the cordless lamp assembly and method are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1 in the drawings, a preferred embodiment of a cordless decorative lamp 8 according to the present application is illustrated. Cordless decorative lamp 8 preferably includes a generally hollow lamp vessel 18, having a top 19, and a bottom 17. Coupled to the top of the lamp vessel 19 is a neck 66. Coupled to the opposite end of neck 66 from lamp vessel 18 is a standard socket 14. Socket 14 is coupled to a lighting element 10 by screwing a threaded end of lighting element 10 into a threaded end of the socket 14. A lamp shade assembly 11 is secured between socket 14 and neck 66. Lamp shade assembly having a lamp shade 16 coupled to the top of a harp 12 by screwing a finial 28 to harp 12. Lamp shade 16 should be easily removable as to allow the user to swap lamp shade 16 with an additional lamp shade. This allows the user to coordinate the decorative element of the cordless decorative lamp 8 with the intended space.

Figure 2:
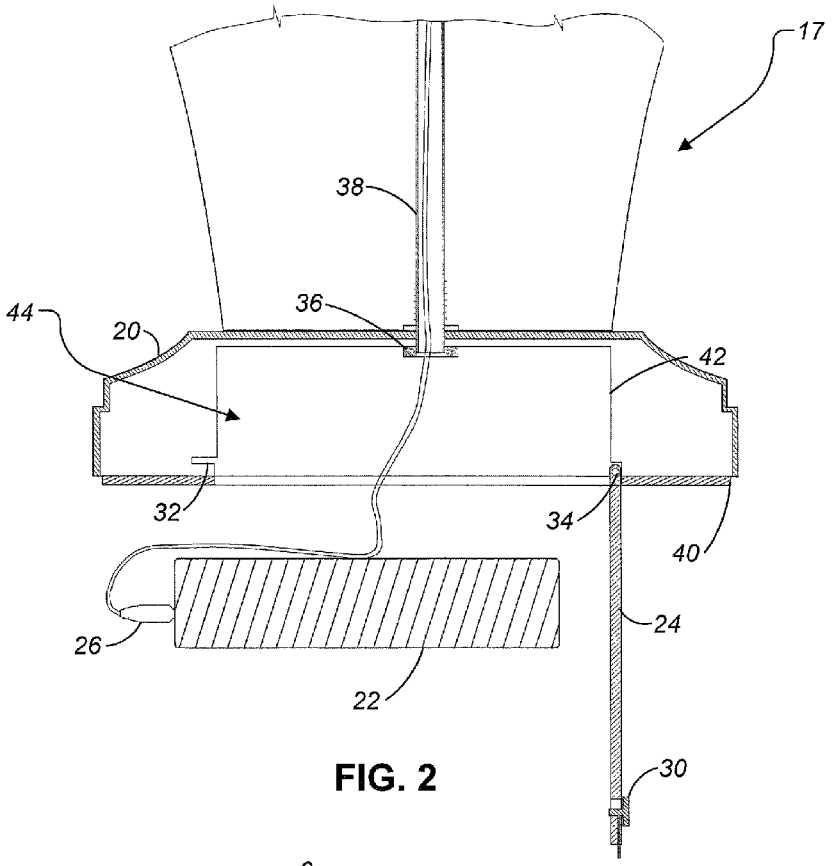
FIG. 2 is a partial cross-sectional view of the cordless decorative lamp of FIG. 1 taken at II-II in FIG. 1.

The lamp vessel bottom 17 is coupled to a base cover 20 by inserting the threaded tube 38 through a power compartment bracket 42 into the base cover 20 and securing the threaded tube by a nut 36 as shown in FIG. 2. Base cover 20 is a upper surface of base. Coupled to the base cover 20 is a lamp bottom 40. The base cover is comprised of a power compartment lid 24 coupled to the lamp bottom by means of a hinge 34. Located on an end of the power compartment lid 24 opposite of the hinge 34 is a sliding clip 30. The sliding clip 30 is insertable into a sliding clip receiving end 32 thereby creating a power compartment 44.

Referring to FIG. 2 in the drawings, an energy storage device 22 is located in the power compartment 44. Energy storage device 22 can be removed from the power compartment 94 as necessary to allow the user to recharge energy storage device 22 or to insert an additional energy storage device 22. In an alternative embodiment energy storage device 22 can be carried by the vessel portion 19 by clips, brackets, hook and loop tape.

Figure 3:
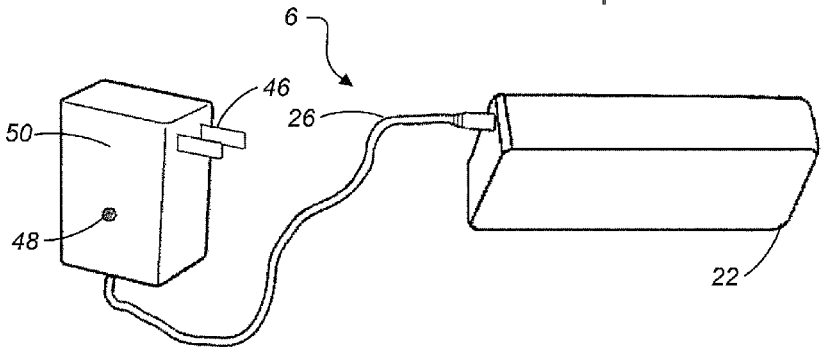
FIG. 3 is a perspective view of the preferred embodiment of an energy storage subsystem according to the present application.

Referring now also to FIG. 3 in the drawings, the preferred embodiment of an energy storage subsystem 6 according to the present application is illustrated. The energy storage subsystem 6 includes of a charger 50 that conductively couples to the energy storage device 22 via a male power cable 26. The preferred embodiment of the energy storage subsystem 6 includes charger 50 that charges energy storage device 22 via male power cable 26 where the energy storage device 22 is a 12 volt lithium-ion battery pack with a mAh rating of 6800. Energy storage device 22 preferably comprises a rechargeable battery for storing electrical energy; however, energy storage device 22 may alternatively comprise any rechargeable electrical power storage device, such as a capacitor, battery pack, fuel cell, or any other suitable device for storing electrical energy, or combination thereof. It is evident that the energy storage device 22 in an alternative embodiment be a single use device like a one time use battery pack the user consumes and disposes of after one use. Preferred charger 50 has a 120V AC male plug 46 capable of being inserted into a conventional wall outlet and an indicator light 48 however other voltages may be utilized to operate the charger. Indicator light 48 indicates to the user the condition of the battery while connected to the charger 50. Indicator light 48 displays different colors or multiple colors depending upon the amount of energy stored in the energy storage device 22. The indicator light 48 blink if energy storage device 22 needs to be replaced. In an alternative embodiment the energy storage device could contain a port for conductively coupling a existing alternating power cord from a lamp.

In FIG. 1, energy storage device 22 is connected to the socket 14 by a power cable 26. The preferred embodiment of the socket 14 is an E26 type socket with a switch 82 located in the socket 14 however other sized sockets are useable as long as they are sized appropriately. The switch 82 allows the user to control whether lighting element 10 receives power from the energy storage device 22. The preferred embodiment of lighting element 10 is a 12V direct current LED bulb sized for E26 type screw in type sockets. Other bulbs can be used as long as the bulb was matched to the socket and to the power source. In an alternative embodiment lighting element 10 is comprised of a variety of different LEDs as to allow different colors and intensities.

Figure 4:
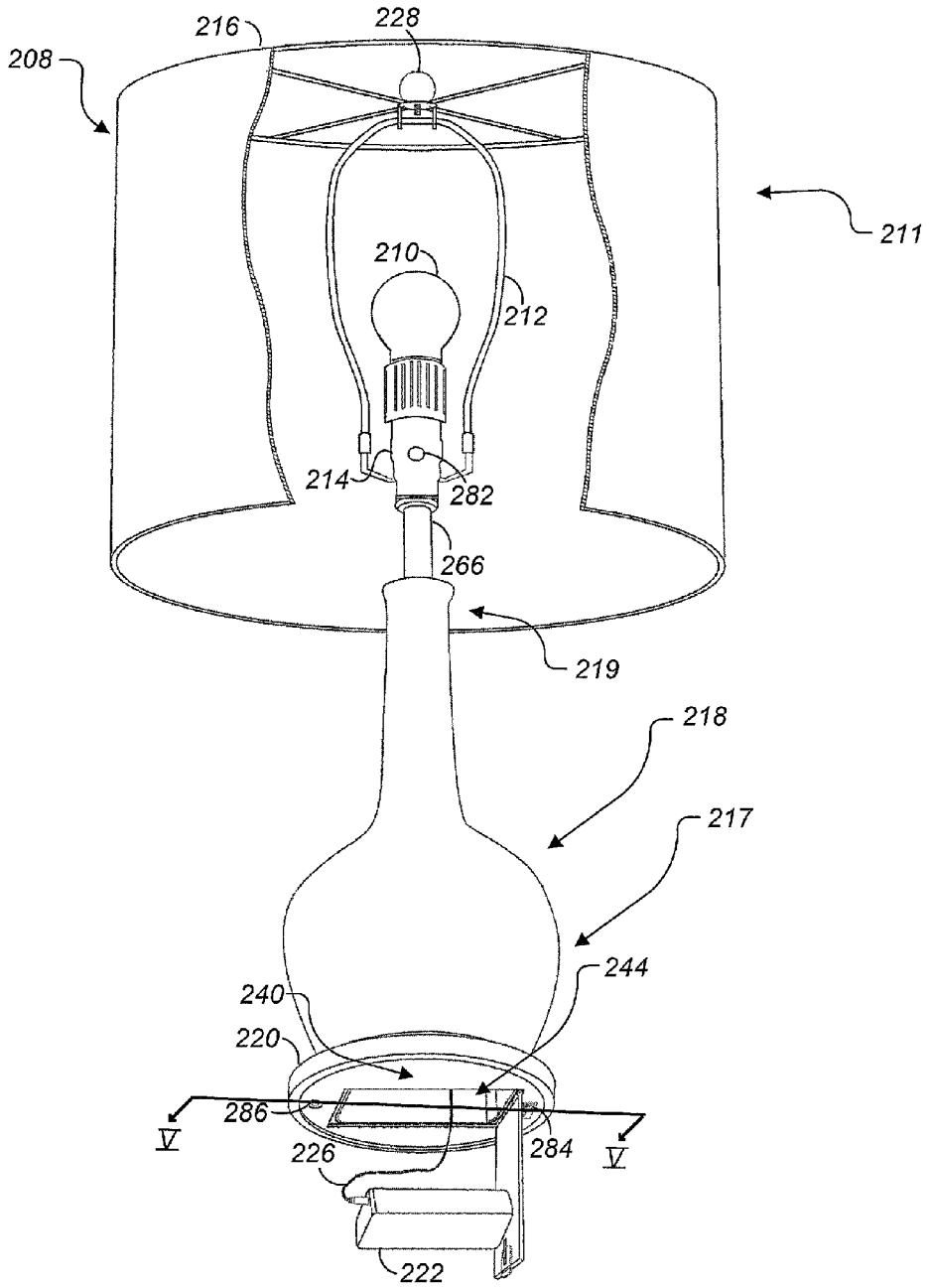
FIG. 4 is a perspective view of an alternate embodiment of a cordless decorative lamp according to the present application.

Referring now also to FIG. 4 in the drawings, an alternative embodiment of a cordless decorative lamp 208 is illustrated. In this embodiment, a status indicator 286 and multi mode switches 284 are located in the lamp bottom 240. Cordless decorative lamp 208 preferably comprises a generally hollow lamp vessel 218, having a top region 219, and a bottom region 217. Coupled to the top of the lamp vessel 219 is a neck 266. Coupled to the opposite end of the neck 266 from the lamp vessel 218 is a standard socket 214. The socket 214 is coupled to a lighting element 210 by screwing a threaded end of lighting element 210 into a threaded end of the socket 214. A lamp shade assembly 211 is secured between the socket 214 and the neck 266. Lamp shade assembly having a lamp shade 216 coupled to the top of the harp 212 by a securing means, such as coupling a finial 228 to the harp 212. Lamp shade 216 should be easily removable as to allow the user to swap lamp shade 216 with an additional lamp shade 216. Thereby allowing the user to coordinate the decorative element of the cordless decorative lamp 208 with the intended space.

Figure 5:
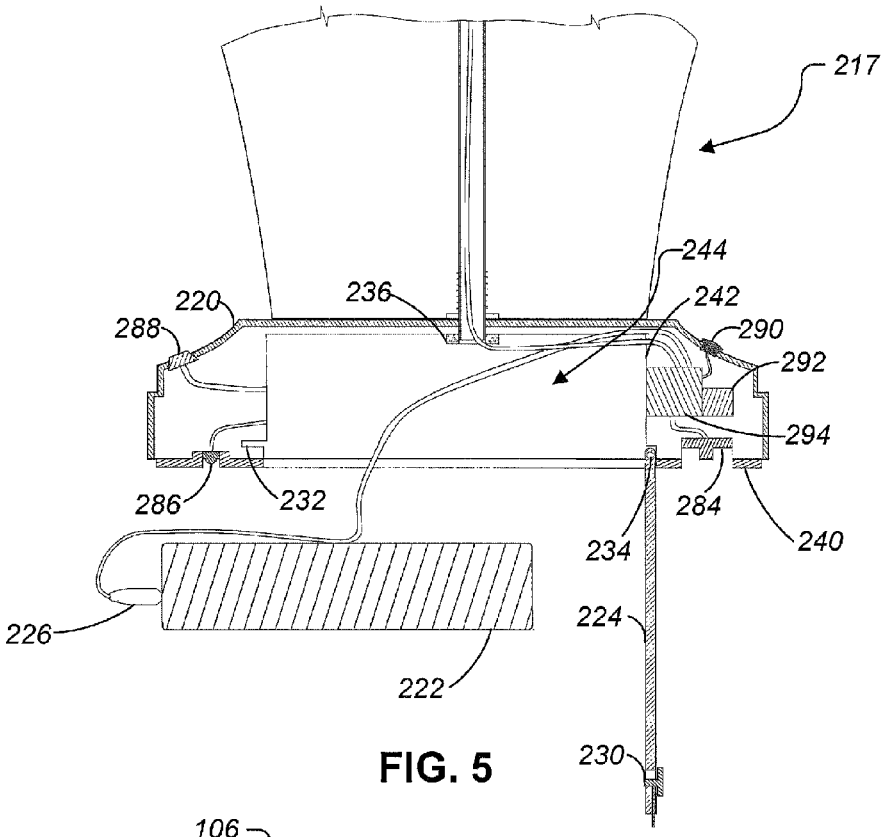
FIG. 5 is a partial cross-sectional view of the cordless decorative lamp of FIG. 4 taken at V-V in FIG. 4.

The lamp vessel bottom 217 is coupled to a base cover 220 by inserting the threaded tube 238 through a power compartment bracket 242 into the base cover 220 and securing the threaded tube by a nut 236 as shown in FIG. 5. Coupled to the base cover 220 is a lamp bottom 240. The base cover is comprised of a power compartment lid 224 coupled to the lamp bottom by means of a hinge 234. Located on an end of the power compartment lid 224 opposite of the hinge 234 is a sliding clip 230. The sliding clip 230 is insertable into a sliding clip receiving end 232 thereby creating a power compartment 244.

In this embodiment there is a light sensor 288 and a motion sensor 290 mounted to the base cover 220 see FIG. 5. Status indicator 286 indicates to the user the condition of energy storage system 222 the status indictor 286 would blink to alert the user that energy storage system 222 needs to be replaced due to a lack of stored energy or that energy storage system 222 is nearing the end of its useable life. Status indicator 286 may also indicate the status of the controller to aid the user in adjusting the controller 294. It should be apparent that the sensors, switches, and indicators can readily be installed anywhere on the cordless decorative lamp 208 as long as they were accessible and blended with the decorative style of the lamp and that there may be a need for a combination of less sensors, switches, and indicators. In the region between the base cover 220 and the lamp bottom 240 there is a controller 294 coupled to the power compartment bracket 242 see FIG. 5. Additionally a wireless module 292 is coupled to the controller 294. The wireless module 292 allows the cordless decorative lamp 208 to be remotely controlled by a cell phone, a computer, a wireless remote, or home automation network. The controller 294 may contain a timer that turns the cordless decorative lamp 208 off after a preselected time. The controller 294 takes inputs from the light sensor 288 and turn the lamp on when the ambient light surrounding the cordless decorative lamp 208 falls below some threshold. The controller 294 takes input from the motion sensor 290 and decide to turn on and off the lamp based upon some physical motion in proximity to the cordless decorative lamp 208. The multi mode switches 284 enables the user to select how the controller 294 functions. An example is where one user likes the cordless decorative lamp 208 to turn itself off after a period of time. One of the multi mode switches 284 is used to turn the timer off or to change the parameters of the timer.

Figure 6:
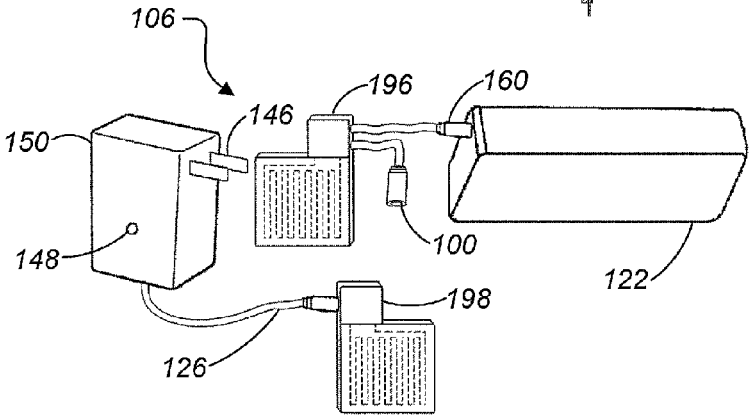
FIG. 6 is a perspective view of an alternate embodiment of an energy storage subsystem according to the present application.

Referring now also to FIG. 6 in the drawings, an alternative embodiment of an energy storage subsystem 106 according to the present application is illustrated. The energy storage subsystem 106 includes of a charger 150 that conductively couples to the energy storage device 122 by coupling a wireless charging transmission module 198 with a wireless charging receiving module 196. The alternative embodiment of the energy storage subsystem 106 includes a 120 v wall charger that charges the energy storage device 122 by coupling a wireless charging transmission module 198 with a wireless charging receiving module 196 where the energy storage device 122 is a 12 volt lithium-ion battery pack with a mAh rating of 6800. In this embodiment there is a male plug 160 and a female plug 100 in order for the battery pack to stay within the cordless decorative lamp while charging occurs. The male power cable 126 plugs into the receptacle 100 to allow the cordless decorative lamp 8 to function. Energy storage device 122 preferably comprises a rechargeable battery for storing electrical energy; however, the energy storage device 122 may alternatively comprise any rechargeable electrical power storage device, such as a capacitor, battery pack, fuel cell, or any other suitable device for storing electrical energy, or combination thereof. The energy storage device 122 in an alternative embodiment may be a single use device like a one time use battery pack the user consumes and disposes of after the one use. The preferred charger 150 has a 120V AC male plug 146 capable of being inserted into a conventional wall outlet and an indicator light 148, however the voltage of the charger 150 may be changed depending upon the power sources voltage. Indicator light 148 indicates to the user what the condition of the battery is while connected to the charger 150. For example the indicator light illuminate different colors depending upon the amount of energy stored in the energy storage device 122. The indicator light 148 blink if the energy storage device 122 needs to be replaced.

Figure 7:
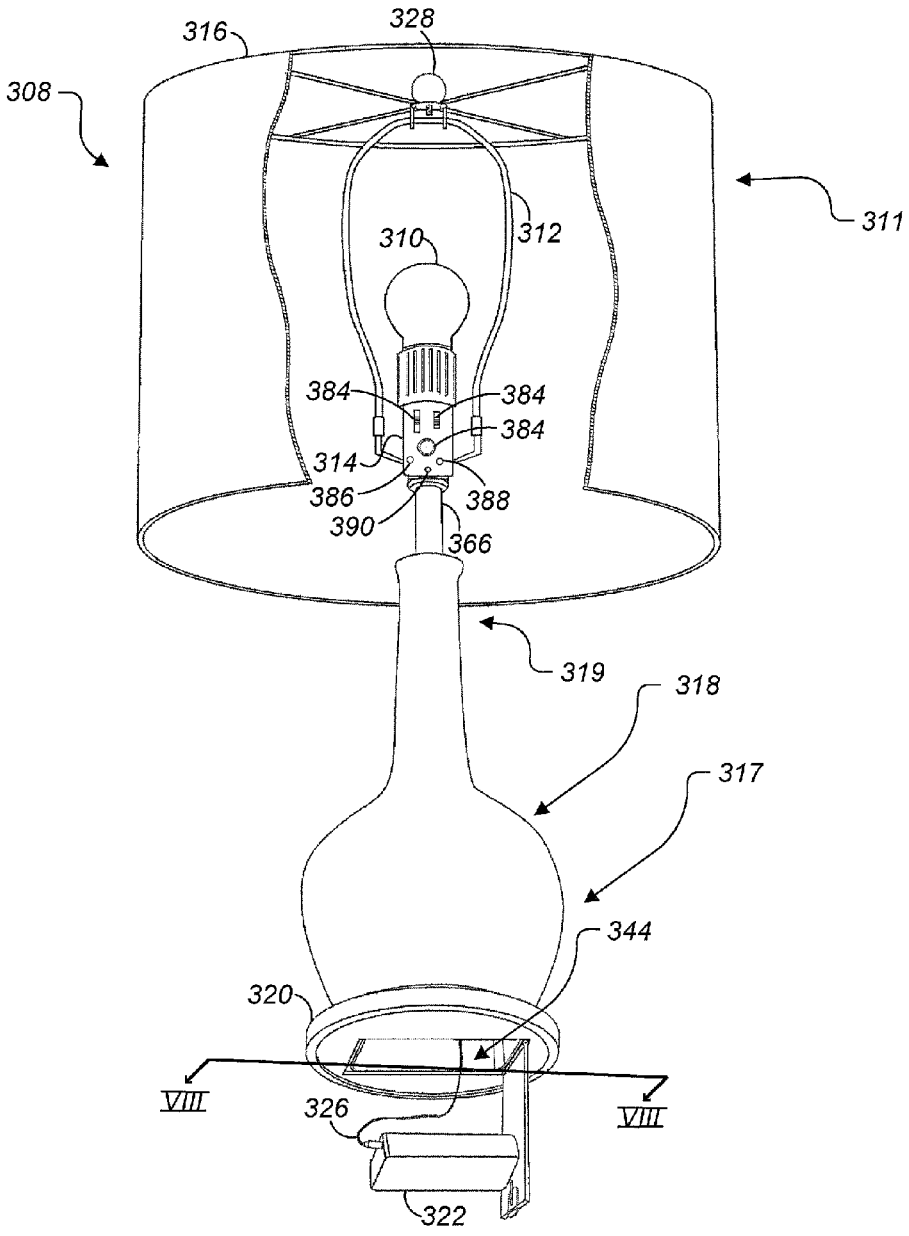
FIG. 7 is a perspective view of an alternate embodiment of a cordless decorative lamp according to the present application.

Referring now also to FIG. 7 in the drawings, an alternative embodiment of a cordless decorative lamp 308 is illustrated. In this embodiment there is a status indicator 386 and multi mode switches 384 located in a smart socket 314. Cordless decorative lamp 308 preferably comprises a generally hollow lamp vessel 318, having a top region 319, and a bottom region 317. Coupled to the top of the lamp vessel 319 is a neck 366. Coupled to the opposite end of the neck 266 from the lamp vessel 218 is socket 314. Socket 314 is coupled to a lighting element 310 by screwing a threaded end of lighting element 310 into a threaded end of the socket 314. A standard harp 312 is secured between the socket 314 and the neck 366. Lamp shade assembly 311 having a lamp shade 316 coupled to the top of the harp 312 by a securing means, such as coupling a finial 328 to the harp 312. Lamp shade 316 should be easily removable as to allow the user to swap lamp shade 316 with an additional lamp shade 316. Thereby allowing the user to coordinate the decorative element of the cordless decorative lamp 308 with the intended space.

Figure 8:
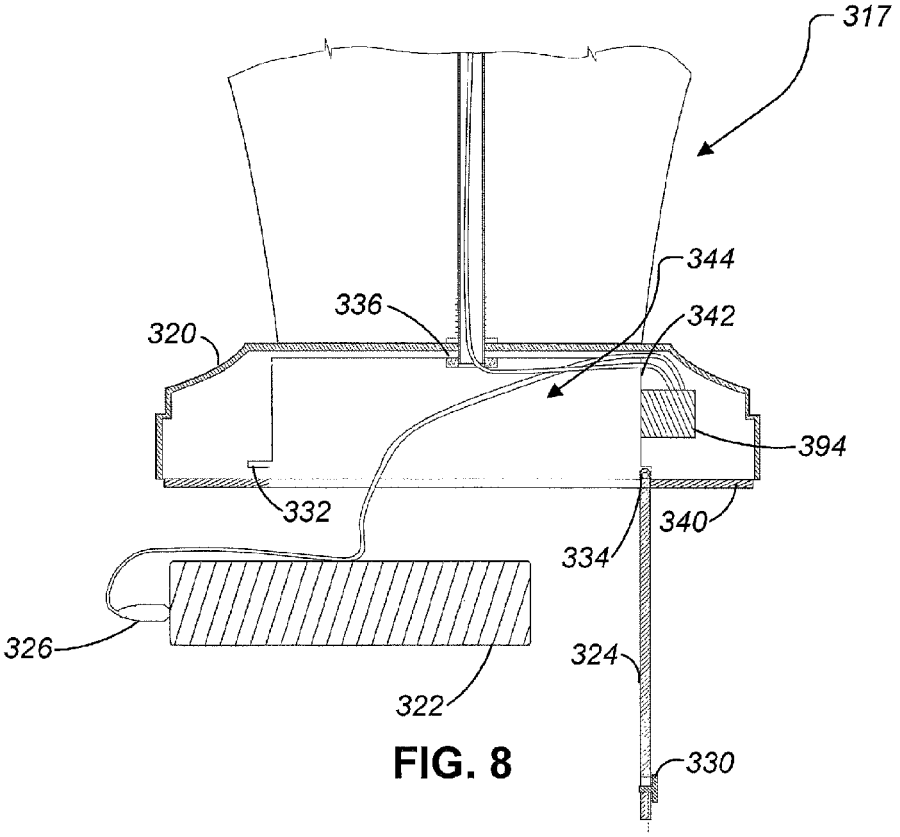
FIG. 8 is a partial cross-sectional view of the cordless decorative lamp of FIG. 7 taken at VIII-VIII in FIG. 7.

The lamp vessel bottom 317 is coupled to a base cover 320 by inserting the threaded tube 338 through a power compartment bracket 342 into the base cover 320 and securing the threaded tube by a nut 336 as shown in FIG. 7 and FIG. 8. Coupled to the base cover 320 is a lamp bottom 340. The base cover is comprised of a power compartment lid 324 coupled to the lamp bottom by means of a hinge 334. Located on an end of the power compartment lid 324 opposite of the hinge 334 is a sliding clip 330. The sliding clip 330 is insertable into a sliding clip receiving end 332 thereby creating a power compartment 344.

In this embodiment there is a light sensor 388 and a motion sensor 390 mounted to socket 314. It should be apparent that the sensors, switches, and indicators can readily be installed anywhere on socket 314 as long as they were accessible and blended with the decorative style of the lamp and that there may be a need for a combination of less sensors, switches, and indicators. In the region between the base cover 320 and the lamp bottom 340 there is a controller 394 coupled to power compartment bracket 342 see FIG. 8. Controller may contain a timer that turns the cordless decorative lamp 308 off after a preselected time. Controller 394 takes inputs from light sensor 388 and turns the lamp on when the ambient light surrounding cordless decorative lamp 308 falls below some threshold. Controller 394 takes inputs from motion sensor 390 and decides to turn on and off the lamp based upon some physical motion in proximity to cordless decorative lamp 308. Multi-mode switches 384 enable the user to select how controller 394 functions. An example is where one user likes cordless decorative lamp 308 to turn itself off after a period of time. One of the multi mode switches 384 is used to turn the timer off or alternatively to adjust the setting of the timer.

It should be appreciated that the lighting element 310 and controller 394 may include selected components, circuitry, and microprocessor control chips to produce a variety of optional features. For example, optional features may include: manual lighting intensity controls, blinking lights, fading lights, changing the light color, motion activated lighting, sound activated lighting, a wide variety of lighting sequence or motion effects, and any other appropriate lighting effects or interactive means for controlling lighting effects. Of course, any components, circuitry, microprocessor control chips, or other means of controlling or altering the functionality of electrical subsystem is conductively coupled to the electrical subsystem. Further, where electrical subsystem is not a lighting element 310, it should be appreciated that similar controls, programming capabilities, interactive input devices, and other electrical subsystem performance controls or alteration means may be incorporated into the electrical subsystem and/or the associated controller 394.

Figure 9:
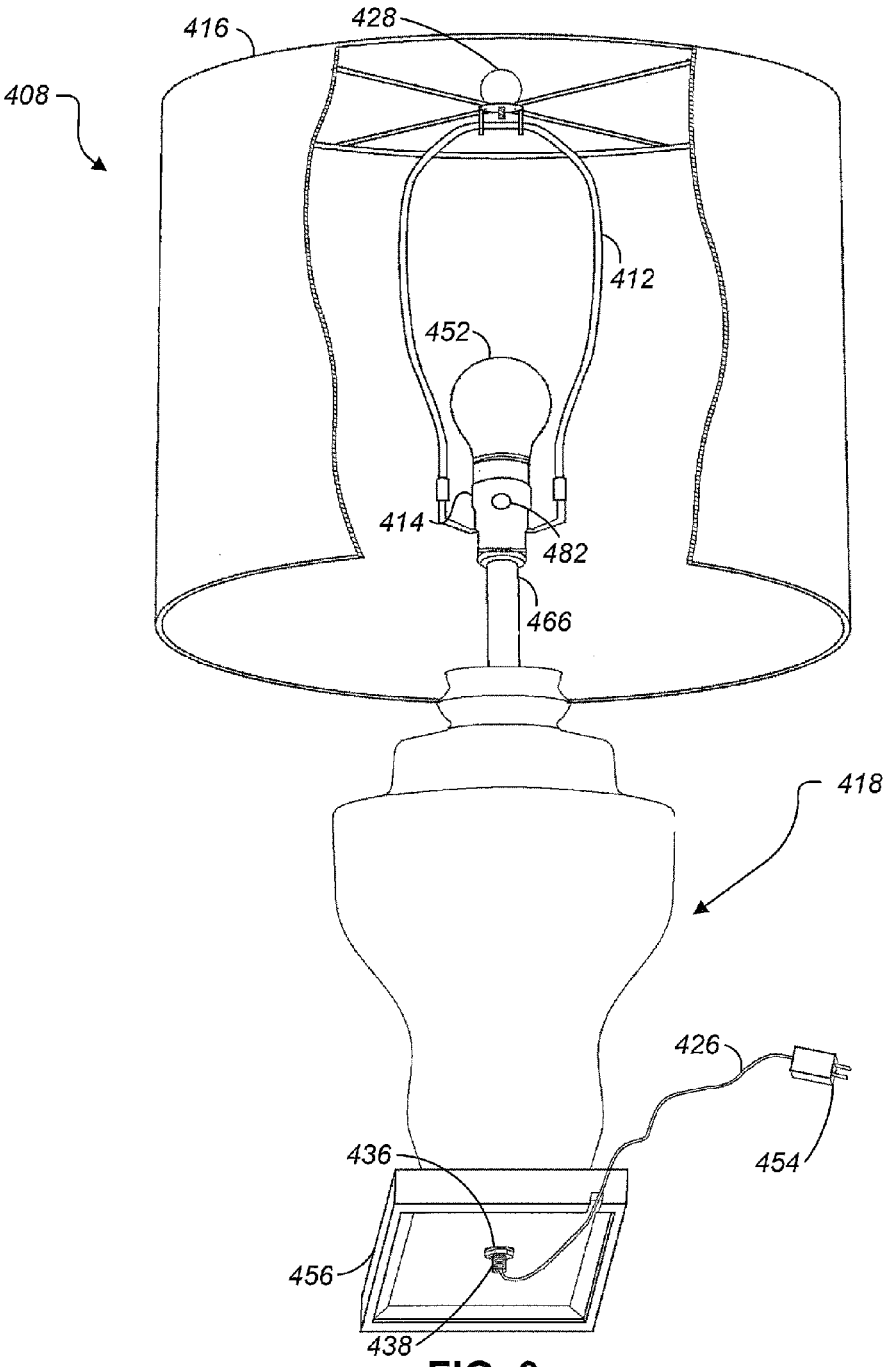
FIG. 9 (Prior Art)
FIG. 9 is a perspective view of a conventional decorative table lamp.

In FIG. 9 is an example of a prior art corded lamp. A base 456 is connected to a lamp vessel 418 secured by a nut 436 threaded on a threaded tube 438 located in the bottom of the lamp vessel 418 and the base 456. Mounted on the top of the lamp vessel is a neck 466. Secured to the end of the neck opposite the lamp vessel is a socket 414. Tied between the socket and the neck is the bottom of the standard harp 412. A standard harp 412 is secured between the socket 414 and the neck 466. A lamp shade is coupled to the top of the harp 412 by screwing a finial 428 to the harp 412. An electrical circuit is comprised of a 120V alternating current power cord 426 conductively coupled to the socket 414. The socket 414 is conductively coupled to the 120V incandescent light bulb 452 by screwing a threaded end of the light bulb 452 into a threaded end of the socket 414. Control of the light bulb 452 is by a switch 482 located in the socket 414.

Figure 10:
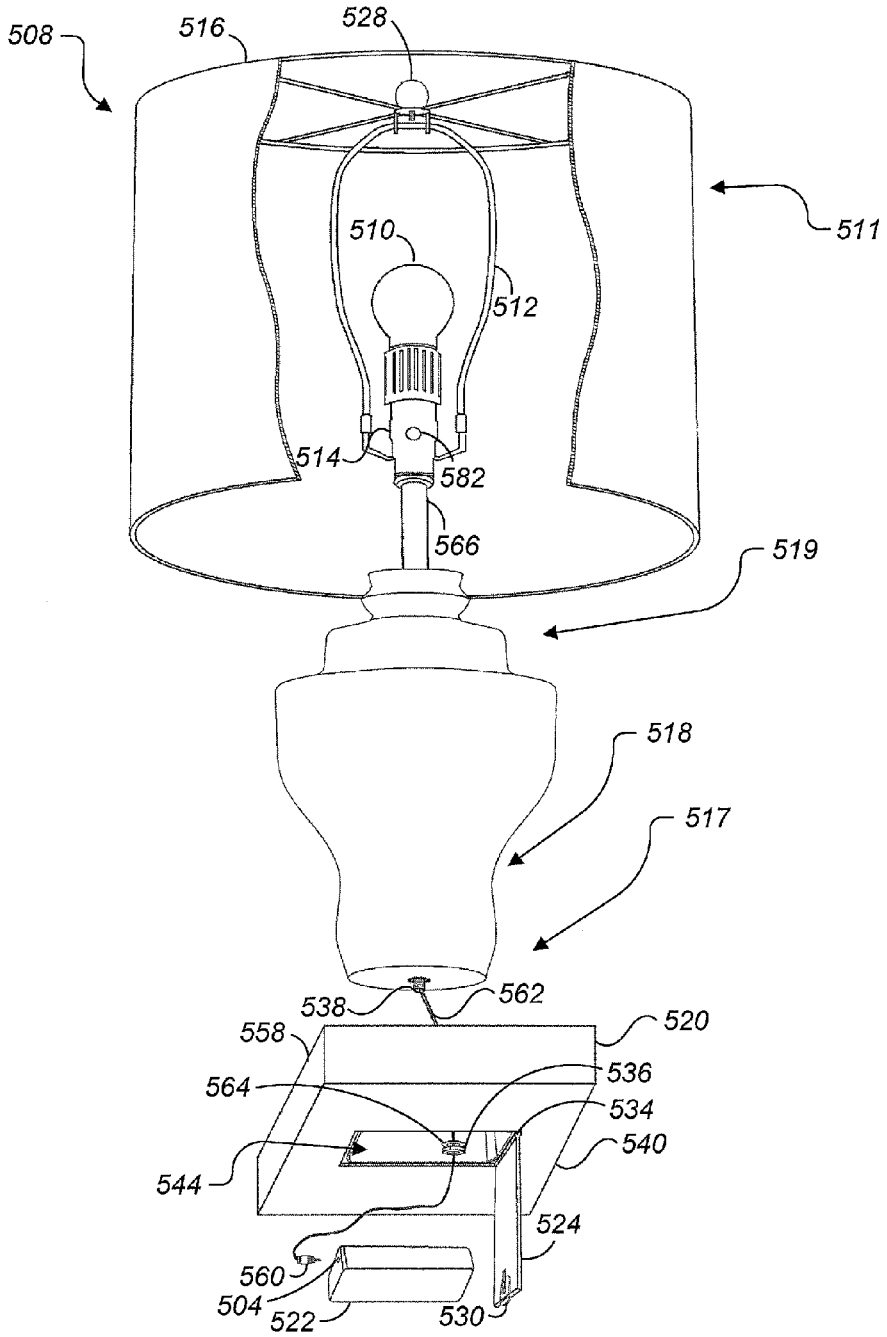
FIG. 10 is a perspective view of an alternate embodiment of a cordless decorative lamp according to the present application.

FIG. 10 is an alternative embodiment of a cordless decorative lamp 508. In this embodiment an existing corded lamp is retrofitted to be cordless. Retrofitted lamp 508 preferably comprises a lamp vessel 518, lamp vessel 518 has a top region 519 and a bottom 517. Coupled to the top region 519 of the lamp vessel 518 is a neck 566. Coupled to the opposite end of the neck 566 from the lamp vessel 518 is a standard socket 514. The socket 514 is physically coupled to a lighting element 510 by screwing the threaded end of lighting element 510 into the threaded end of the socket 514. A standard harp 512 is secured between the socket 514 and the neck 566. Lamp shade assembly 511 having a lamp shade 516 coupled to the top of the harp 512 by a securing means, such as coupling a finial 528 to the harp 512. Lamp shade 516 should be easily removable as to allow the user to swap lamp shade 516 with an additional lamp shade 516. Thereby allowing the user to coordinate the decorative element of the cordless decorative lamp 508 with the intended space.

A retrofit base 558 is connected to a lamp vessel 518 secured by a washer 564 and a nut 536 threaded on a threaded tube 538 located in the bottom of the lamp vessel 518 and the retrofit base 558. Coupled to the base cover 520 is a lamp bottom 540. The base cover is comprised of a power compartment lid 524 coupled to the lamp bottom 540 by means of a hinge 534. Located on an end of the power compartment lid 524 opposite of the hinge 534 is a sliding clip 530.

The electrical subsystem of alternative embodiment of FIG. 10 includes a energy storage device 522 conductively connected to the socket 514 by a male power cable 562. Male power cable 562 is made from the existing 120V wiring 426 located in the lamp (See FIG. 9). Removal of existing 120V incandescent light bulb 452 is required replaced by lighting element 510 and existing 120V wiring 426 may need trimming so that only a few inches of 120V wiring 426 protrude out the bottom of the lamp vessel 518. The existing 120V wiring 426 is stripped to the metallic conductor located in the existing 120V wiring 426. The metallic conductor then must be physically and conductively coupled to the male DC power connector 560. Care must be used to determine which metallic conductor will be coupled to the positive terminal of the male DC power connector 560 and which to the negative terminal of the male DC power connector 560. Thereby allowing the power cord 560 to couple to port on energy storage device 504. The lighting element 510 is conductively connected to the socket 514. Power to the lighting element 510 is controlled by the light switch 582.

Figure 11:
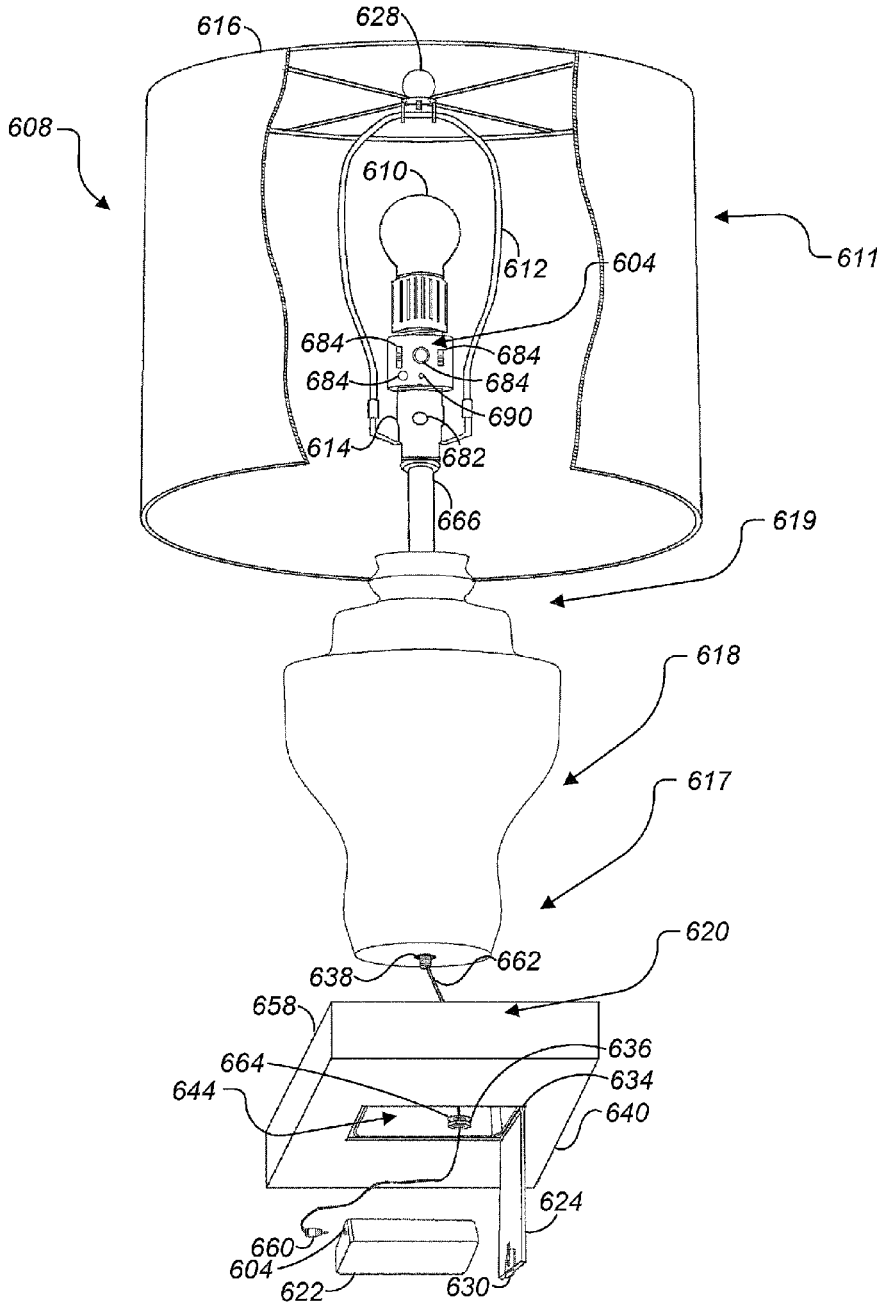
FIG. 11 is a perspective view of an alternate embodiment of a cordless decorative lamp according to the present application.

FIG. 11 is an alternative embodiment of a cordless decorative lamp 608. In this embodiment an existing corded lamp is retrofitted to be cordless. Retrofitted lamp 608 preferably comprises a lamp vessel 618, lamp vessel 618 has a top 619 and a bottom 617. Coupled to the top of the lamp vessel 618 is a neck 666. Coupled to the opposite end of the neck 666 from the lamp vessel 618 is a standard socket 614. The socket 614 is coupled to a lighting element 610 by screwing a threaded end of the lighting element 610 into a threaded end of the socket 614. A standard harp 612 is secured between the socket 614 and the neck 666. Lamp shade assembly 611 having a lamp shade 616 coupled to the top of the harp 612 by a securing means, such as coupling a finial 628 to the harp 612. Lamp shade 616 should be easily removable as to allow the user to swap lamp shade 616 with an additional lamp shade 616. Thereby allowing the user to coordinate the decorative element of the cordless decorative lamp 608 with the intended space.

A retrofit base 658 is connected to a lamp vessel 618 secured by a washer 664 and a nut 636 threaded on a threaded tube 638 located in the bottom of the lamp vessel 618 and the retrofit base 658. Coupled to the base cover 620 is a lamp bottom 640. The base cover is comprised of a power compartment lid 624 coupled to the lamp bottom 640 by means of a hinge 634. Located on an end of the power compartment lid 624 opposite of the hinge 634 is a sliding clip 630. Retrofit base 658 may not need to be removed from existing alternating current lamp. Lamp vessel 618 may contain a energy storage subsystem 622.

The electrical subsystem of alternative embodiment of FIG. 11 includes energy storage device 622 conductively connected to the socket 614 by a male power cable 662. Male power cable 662 is made from the existing 120V wiring 426 located in the lamp (See FIG. 9). Removal of existing 120V incandescent light bulb 452 is required, replaced by lighting element 610 and existing 120V wiring 426 may need trimming so that only a few inches of wire 426 protrude out the bottom of the lamp vessel 618. The existing 120V wiring 426 will need stripping to the metallic conductor located in the existing 120V wiring 426. The metallic conductor power cord is physically and conductively coupled to the male DC power connector 660 or may be called power terminal. Care must be used to determine which metallic conductor will be coupled to the positive terminal of the male DC power connector 660 and which to the negative terminal of the male DC power connector 660. The lighting element 610 is conductively connected to a lamp adapter 604. The lamp adapter 604 is conductively connected to the socket 614. Power to the lighting element 610 is controlled by the light switch 682 or by the lamp adapter 604.

In this embodiment there is a status indicator 686 and multi mode switches 684 located in the lamp adapter 604. In this embodiment there is a light sensor 688 and a motion sensor 690 mounted to the lamp adapter 604. It should be apparent that the sensors, switches, and indicators can readily be installed anywhere on the lamp adapter 604 as long as they were accessible and blended with the decorative style of the lamp and that there may be a need for a combination of less sensors, switches, and indicators. In the region between the base cover 620 and the lamp bottom 640 there is a controller 694 coupled to the power compartment bracket 642. Controller component 694 is located in the lamp adapter 604 in an alternative embodiment see FIG. 11. The controller may contain a timer that turns the cordless decorative lamp 608 off after a preselected time. The controller 694 takes inputs from the light sensor 688 and turn the lamp on when the ambient light surrounding the cordless decorative lamp 608 falls below some threshold. The controller 694 takes inputs from the motion sensor 690 and decide to turn on and off the lamp based upon some physical motion in proximity to the cordless decorative lamp 608. The multi mode switches 684 enables the user to select how the controller 694 functions. An example is where one user likes the cordless decorative lamp 608 to turn itself off after a period of time. One of the multi mode switches 684 is used to turn the timer off or to adjust the settings of the timer.

Figure 12:
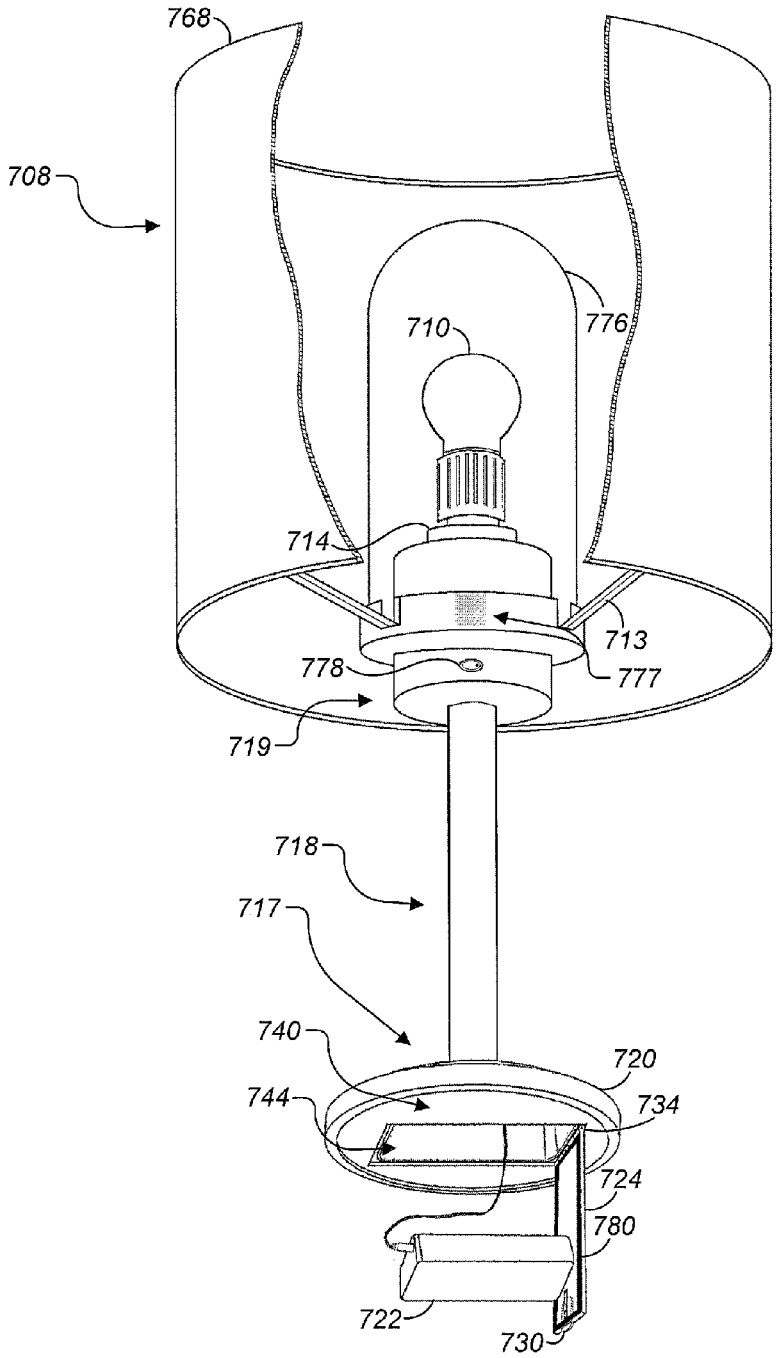
FIG. 12 is a perspective view of an alternate embodiment of a cordless decorative lamp according to the present application.

Referring to FIG. 12 in the drawings, an alternative embodiment of a weatherproof cordless decorative lamp 708 according to the present application is illustrated. Weatherproof cordless decorative lamp 708 preferably comprises a lamp vessel 718, lamp vessel 718 has a top 719 and a bottom 717. Coupled to the top 719 is a housing 777. A socket 714 is coupled to housing 777. Socket 714 is coupled to a lighting element 710 by screwing the threaded end of the lighting element 710 into the threaded end of the socket 714. A lamp shade 768 is coupled to the housing 777 by coupling weatherproof globe 776 into housing 777. The preferred embodiment of the weatherproof globe 776 is a transparent glass container however the material may be formed of plastic or may be colored or translucent. In an alternative embodiment housing 777 has a gasket between weatherproof globe 776 and housing 777.

The lamp vessel 718 is coupled to a base cover 720. Coupled to the base cover 720 is a lamp bottom 740. The base cover is comprised of a power compartment lid 724 coupled to the lamp bottom 740 by means of a hinge 734. Located on an end of the power compartment lid 724 opposite of the hinge 734 is a sliding clip 730. Weatherproof cordless decorative lamp is sealed against the moisture and dirt with extra sealing around the power compartment lid 724 by a gasket 780. Gasket 780 is preferable made of rubber however any material that allows the power compartment lid to be sealed is suitable.

Referring to FIG. 12 in the drawings, an energy storage device 722 is located in the power compartment 744. The energy storage device 722 can be removed from the power compartment as necessary to allow the user to recharge the energy storage device 722 or to insert an additional energy storage device 722.

The energy storage device 722 is conductively connected to the socket 714 and to the weatherproof switch located on the top of the lamp vessel 719. The weatherproof switch 778 controls power from the energy storage device 722 to the socket 714. The LED lighting element 710 is conductively connected to the socket 714.

Figure 13:
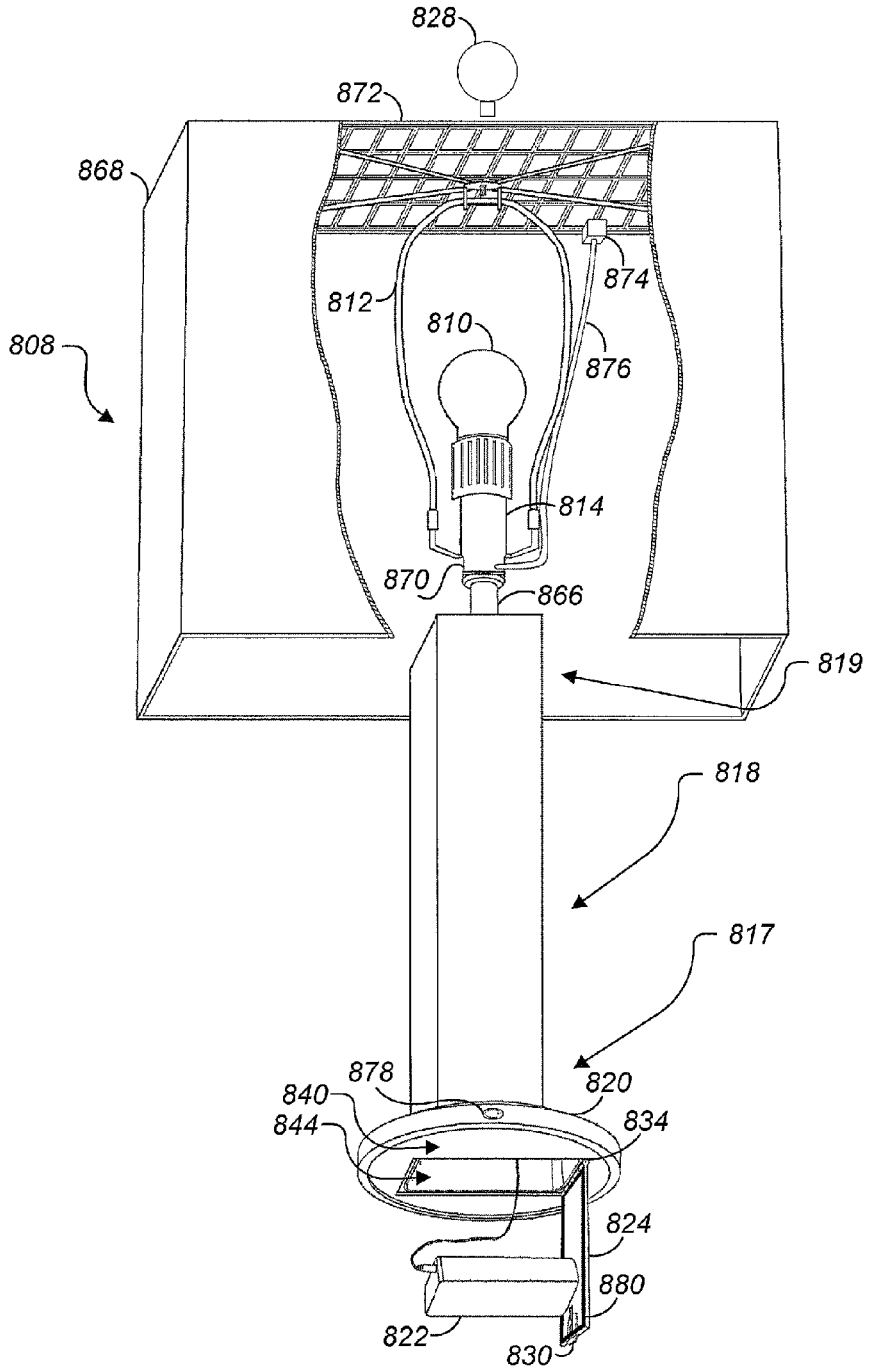
FIG. 13 is a perspective view of an alternate embodiment of a cordless decorative lamp according to the present application.

Referring to FIG. 13 in the drawings, an alternative embodiment of a weatherproof cordless decorative lamp 808 according to the present application is illustrated. Weatherproof cordless decorative lamp 808 preferably comprises a lamp vessel 818, lamp vessel 818 has a top region 819 and a bottom region 817. Coupled to the top of the lamp vessel 819 is a neck 866. Coupled to the opposite end of the neck 866 from the lamp vessel 818 is a socket 814. The socket 814 is coupled to a lighting element 810 by screwing the threaded end of the lighting element 810 into the threaded end of the socket 814. A standard harp 812 is secured between the socket 814 and the neck 866. A lamp shade 816 is coupled to the top of the harp 812 by a securing means, such as coupling a finial 828 to the harp 812. Coupled to the top of the lamp shade 868 is a solar energy collection system 872 for the conversion of sunlight to electrical energy.

The lamp vessel 818 is coupled to a base cover 820. Coupled to the base cover 820 is a lamp bottom 840. The base cover is comprised of a power compartment lid 824 coupled to the lamp bottom 840 by means of a hinge 834. Located on an end of the power compartment lid 824 opposite of the hinge 834 is a sliding clip 830. Weatherproof cordless decorative lamp is sealed against the moisture and dirt with extra sealing around the power compartment lid 824 by a gasket 880. Gasket 880 is preferable made of rubber however any material that allows the power compartment lid 824 to be sealed is suitable.

Referring to FIG. 13 in the drawings, an energy storage device 822 is located in the power compartment 844. The energy storage device 822 can be removed from the power compartment as necessary to allow the user to recharge the energy storage device 822 or to insert an additional energy storage device 822.

The energy storage device 822 is conductively connected to the weatherproof socket 870 and to the weatherproof switch located on the base cover 820. The weatherproof switch 878 controls power from the energy storage device 820 to the socket 870. The lighting element 810 is conductively connected to the socket 870. Additionally the array of solar cells 872 is conductively coupled to the socket 870 by a solar power cable 876.

The purpose of solar collection system 872 is preferably to convert solar energy into electrical energy and to supply that electrical energy to one or more electrical subsystems. In operation, solar energy collection system 872 preferably converts solar energy into electrical energy. Solar energy collection system 872 preferably delivers electrical energy to energy storage device 822. However, when energy storage device 822 is fully charged, solar energy collection system 872 preferably delivers electrical energy to socket 870 where the electrical energy is preferably diverted for uses other than charging energy storage device 822. A charge controller 874 is conductively coupled to the solar cells 872 and to energy storage system 822. Charge controller 874 diverts the excess electrical energy to directly power lighting element 810 rather than lighting element 810 consuming power from energy storage device 822.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A retro-fit base for converting an existing alternating current lamp into a direct current lamp, the retro-fit base comprising:

a base assembly having;

a base cover having only a single hole through the base cover;

a base bottom;

a power compartment bracket;

a gasketed power compartment lid hingedly coupled to the base bottom for securing the energy storage subsystem; and the base cover is directly secured to a lower portion of a threaded rod of the existing lamp by a nut located inside the base cover;

wherein the nut is in contact with the base cover; and wherein removal of the nut allows the base cover to be removed from the existing lamp;

an electrical subsystem carried by the base assembly, the electrical subsystem being configured for attachment to a power cord of the existing lamp and comprising:

a plug located inside the base cover, the plug being configured to electrically couple the electrical subsystem to the power cord of the existing lamp;

an energy storage subsystem electrically coupled to the plug;

a direct current lighting element conductively coupled to the energy storage subsystem by the plug; and a controller for controlling the operation of the direct current lighting element;

wherein the energy storage subsystem is removable from the base assembly; and wherein the single hole through the base cover is configured for coupling the base cover to the lower portion of the threaded rod of the existing alternating current lamp.

2. The retro-fit base according to claim 1, wherein the direct current lighting element is an LED lighting element.

3. The retro-fit base according to claim 1, wherein the energy storage subsystem comprises:

a rechargeable energy storage device; and an alternating current charging device for recharging the rechargeable energy storage device;

wherein the rechargeable energy storage device must be removed from the base assembly and electrically uncoupled from the power cord of the existing lamp in order for the alternating current device to recharge the rechargeable energy storage device.

4. The retro-fit base according to claim 3, wherein the charging device comprises:

a power transmission device; and a power receiving device for inductively transmitting electrical power from the power transmission device to power receiving device.

5. The retro-fit base according to claim 4, wherein the electrical power is transmitted wirelessly.

6. The retro-fit base according to claim 1, wherein the controller comprises:

at least one of the following control components:

a light sensor;

a timer;

a motion sensor;

a wireless interface;

a light intensity switch;

a color switch;

a status indicator; and an on/off switch.

* * * * *